US007210902B2

(12) United States Patent
Song et al.

(10) Patent No.: US 7,210,902 B2
(45) Date of Patent: May 1, 2007

(54) TWO-WAY AIR PUMP

(76) Inventors: Rong-Jyh Song, 8F-1, No. 102, Sec. 2, Roosevelt Rd., Taipei (TW); Tsung-Ping Yen, 8F-1, No. 102, Sec. 2, Roosevelt Rd., Taipei (TW)

( * ) Notice: Subject to any disclaimer, the term of this patent is extended or adjusted under 35 U.S.C. 154(b) by 387 days.

(21) Appl. No.: 10/959,933

(22) Filed: Oct. 5, 2004

(65) Prior Publication Data

US 2006/0073012 A1 Apr. 6, 2006

(51) Int. Cl.
*B63H 1/26* (2006.01)

(52) U.S. Cl. ..... 415/202; 415/203; 415/206

(58) Field of Classification Search ..... 415/202, 415/203, 206

See application file for complete search history.

(56) References Cited

U.S. PATENT DOCUMENTS 2,945,451 A * 7/1960 Griswold ..... 91/491
5,622,621 A * 4/1997 Kramer ..... 210/188
6,776,136 B1 * 8/2004 Kazempour ..... 123/243
7,025,700 B1 * 4/2006 Hoelscher ..... 475/84
7,090,097 B1 * 8/2006 Kazarian et al. ..... 222/144.5

* cited by examiner

*Primary Examiner*—Hoang Nguyen
(74) *Attorney, Agent, or Firm*—Christensen O'Connor Johnson Kindness PLLC

(57) ABSTRACT

A two-way air pump includes a housing, an air flow controller, a check valve, and a valve actuator. The housing confines an air control chamber, and is formed with a valve hole, an air outlet and an air inlet. The air flow controller confines an air impeller chamber, is formed with a hole set, is mounted rotatably in the air control chamber, and is rotatable between inflating and deflating portions to control fluid communication among the valve hole, the air outlet, the air inlet and the air impeller chamber. The check valve is mounted in the valve hole, and is movable between control-enabled and control-disabled positions. The valve actuator is provided on the air flow controller, and drives the check valve to the control-disabled position when the air flow controller is rotated to the deflating position. An air impeller is mounted rotatably in the air impeller chamber.

9 Claims, 4 Drawing Sheets

TWO-WAY AIR PUMP

BACKGROUND OF THE INVENTION

1. Field of the Invention

The invention relates to an air pump, more particularly to a two-way air pump capable of inflating and deflating articles via a single valve hole.

2. Description of the Related Art

A conventional two-way air pump is suitable for use when inflating and deflating large-sized inflatable articles. However, the known two-way air pumps are usually designed to have different routes for air inflation and deflation, and are required to be reassembled when changing from an inflating mode to a deflating mode and vice versa, thereby arising in inconvenience during frequent use of the air pump.

SUMMARY OF THE INVENTION

Therefore, the object of the present invention is to provide a two-way air pump that can overcome the aforesaid drawbacks of the prior art.

Accordingly, the two-way air pump of this invention comprises a housing, an air flow controller, a check valve, a valve actuator, an air impeller, and a drive unit.

The housing confines an air control chamber, and is formed with a valve hole, an air outlet and an air inlet.

The air flow controller confines an air impeller chamber, is formed with a hole set, is mounted rotatably in the air control chamber, and is rotatable between inflating and deflating portions. When the air flow controller is at the inflating position, the hole set is disposed such that the air inlet and the valve hole are in fluid communication with the air impeller chamber, and such that the air outlet is fluidly isolated from the air impeller chamber. When the air flow controller is at the deflating position, the hole set is disposed such that the air outlet and the valve hole are in fluid communication with the air impeller chamber, and such that the air inlet is fluidly isolated from the air impeller chamber.

The check valve is mounted in the valve hole, and is movable between control-enabled and control-disabled positions. When the check valve is at the control-enabled position, the check valve blocks ambient air flow into the air control chamber via the valve hole, and permits air flow from the air control chamber out of the housing through the valve hole. When the check valve is at the control-disabled position, the check valve permits ambient air flow into the air control chamber via the valve hole.

The valve actuator is provided on the air flow controller, and drives the check valve to the control-disabled position when the air flow controller is rotated to the deflating position.

The air impeller is mounted rotatably in the air impeller chamber.

The drive unit is coupled to the air impeller, and drives rotation of the air impeller in the air impeller chamber.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
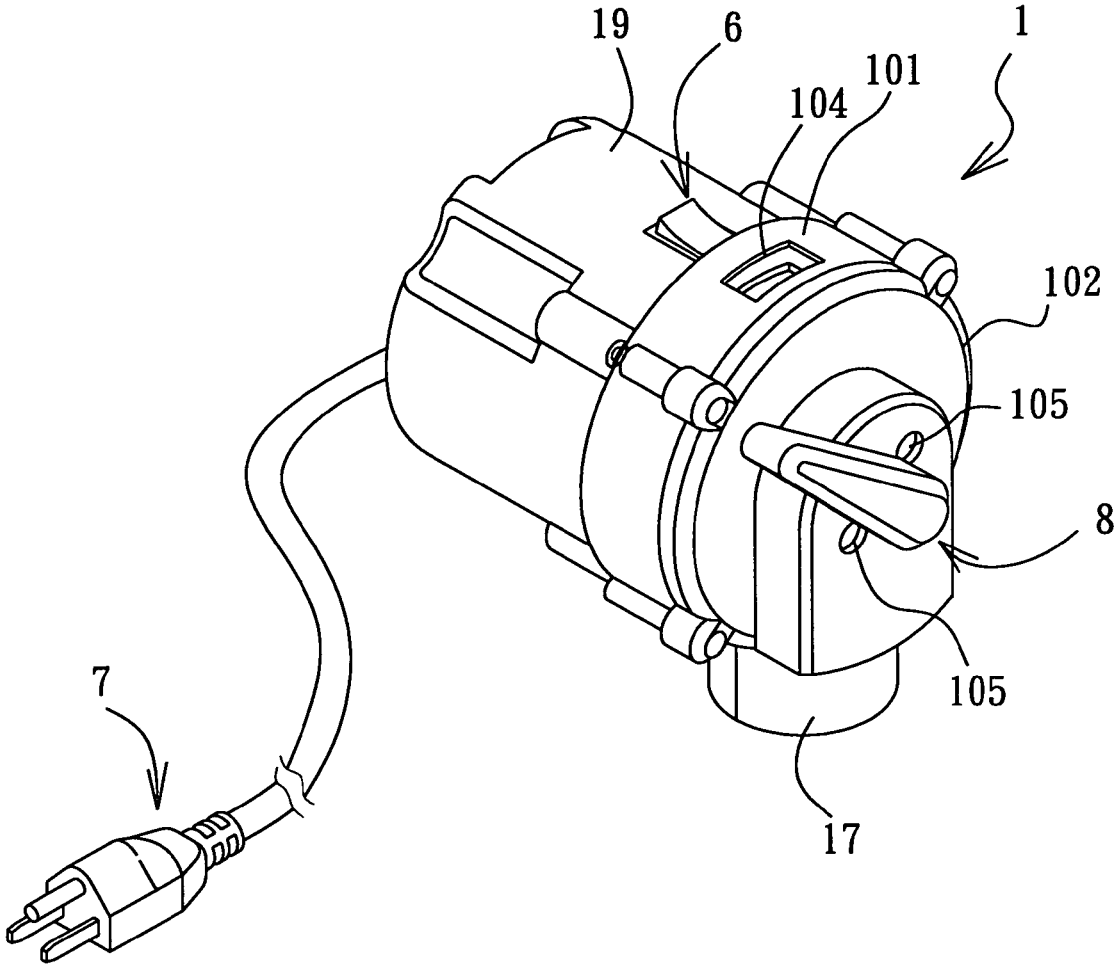
FIG. 1 is an assembled perspective view of the preferred embodiment of a two-way air pump according to the present invention.
Figure 2:
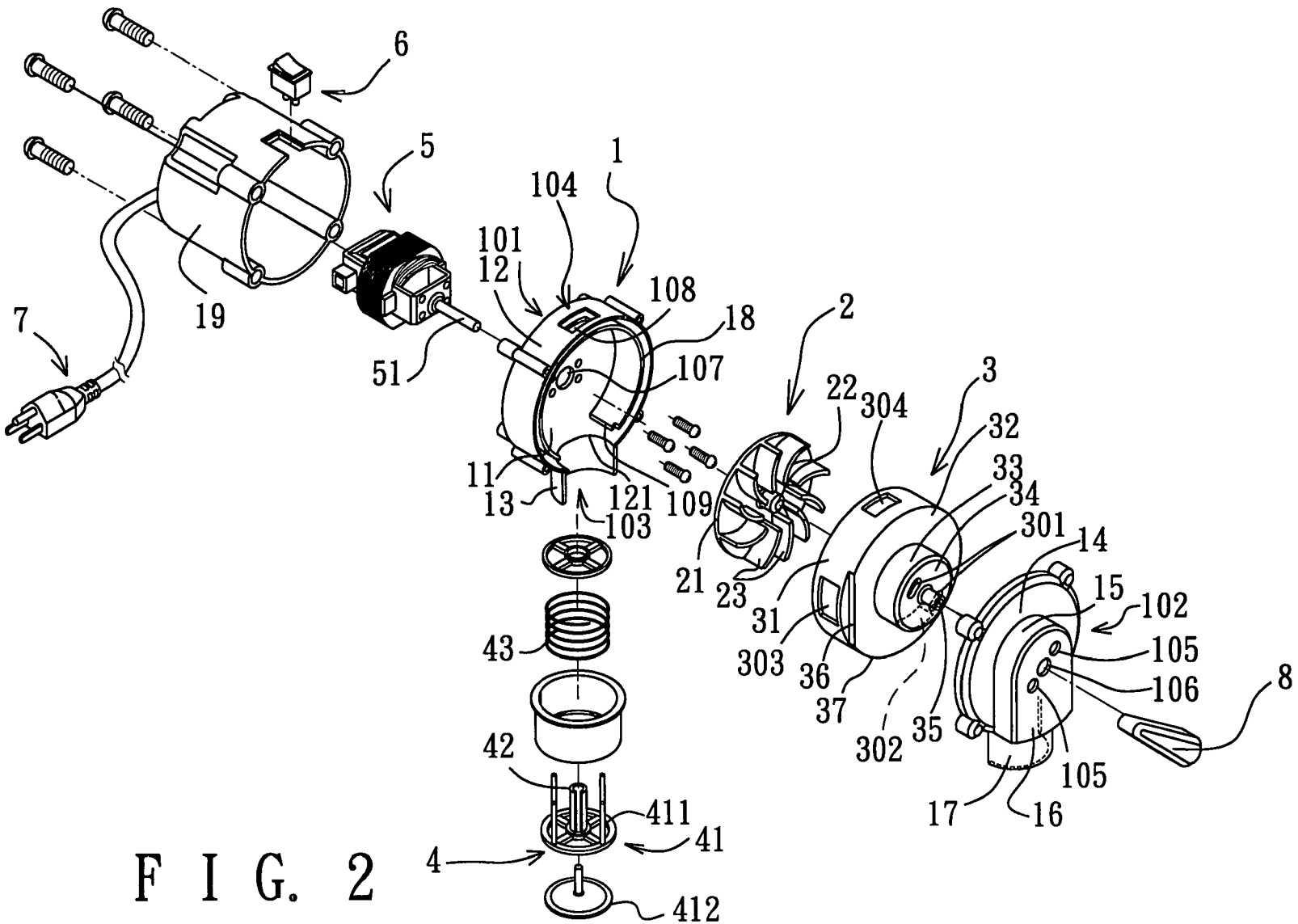
FIG. 2 is an exploded perspective view of the preferred embodiment.
Figure 3:
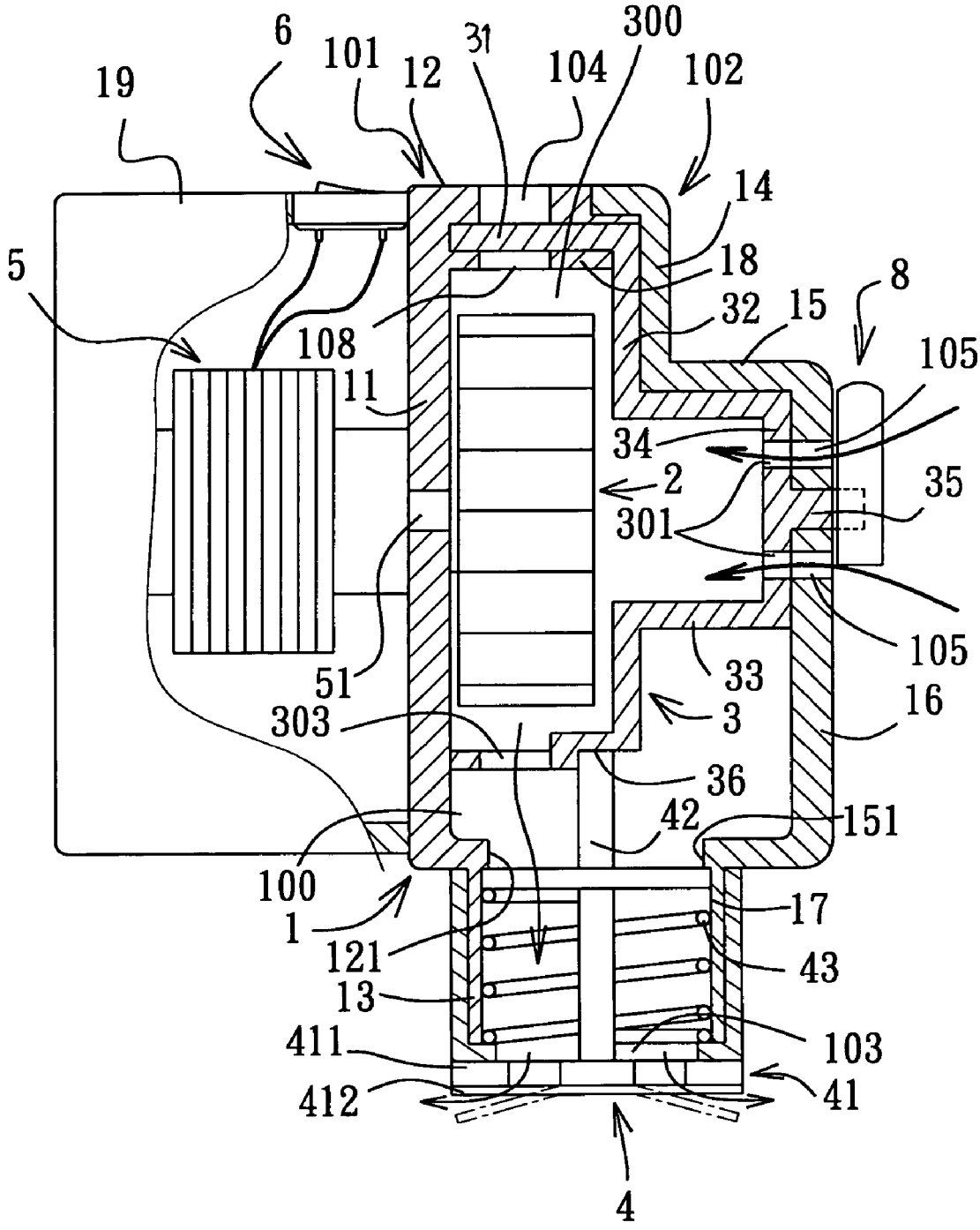
FIG. 3 is a sectional view illustrating the preferred embodiment when operated in an inflating mode.

Referring to FIGS. 1, 2 and 3, the preferred embodiment of a two-way air pump according to the present invention is shown to comprise a housing 1, an air flow controller 3, a check valve 4, a valve actuator 37, an air impeller 2, and a drive unit 5. In this embodiment, the drive unit 5 includes a motor with a drive shaft 51.

The housing 1 confines an air control chamber 100, and is formed with a valve hole 103, an air outlet 104 and a pair of air inlets 105. In this embodiment, the housing 1 includes complementary first and second housing parts 101, 102 that are coupled to each other via a plurality of fasteners.

The first housing part 101 has a first base wall 11 with an outer periphery, a first peripheral wall 12 extending transversely from the outer periphery of the first base wall 11, a first notch 121 formed in the first peripheral wall 12, and a first semi-tubular part 13 extending transversely from and outwardly of the first peripheral wall 12 at a periphery of the first notch 121.

The second housing part 102 has a second base wall 14 configured with an inner periphery and an outer periphery that is connected to the first peripheral wall 12 of the first housing part 101, a second peripheral wall 15 extending transversely from the inner periphery of the second base wall 14 away from the first housing part 101, a third base wall 16 connected to one end of the second peripheral wall 15 that is remote from the second base wall 14, a second notch 151 formed in the second peripheral wall 15, and a second semi-tubular part 17 extending transversely from and outwardly of the second peripheral wall 15 at a periphery of the second notch 151.

The first base wall 11 and the first peripheral wall 12 of the first housing part 101 cooperate with the second base wall 14, the second peripheral wall 15 and the third base wall 16 of the second housing part 102 to confine the air control chamber 100. The first and second semi-tubular parts 13, 17 of the first and second housing parts 101, 102 cooperate to define the valve hole 103. The air outlet 104 is formed in the first peripheral wall 12 of the first housing part 101. The air inlets 105 are formed in the third base wall 16 of the second housing part 102. The third base wall 106 is further formed with a shaft hole 106.

Furthermore, the drive unit 5 is secured to an outer side of the first base wall 11. The first base wall 11 is formed with a shaft hole 107 to permit extension of the drive shaft 51 of the drive unit 5 into the air control chamber 100. In this embodiment, a cap 19 is secured to the first housing part 101 for concealing the drive unit 5. A switch device 6 is mounted on the cap 19, and is operable to control operation of the drive unit 5 in a known manner. A power cord 7 is connected to the drive unit 5, extends through the cap 19, and is adapted for connection to a power source (not shown).

Figure 4:
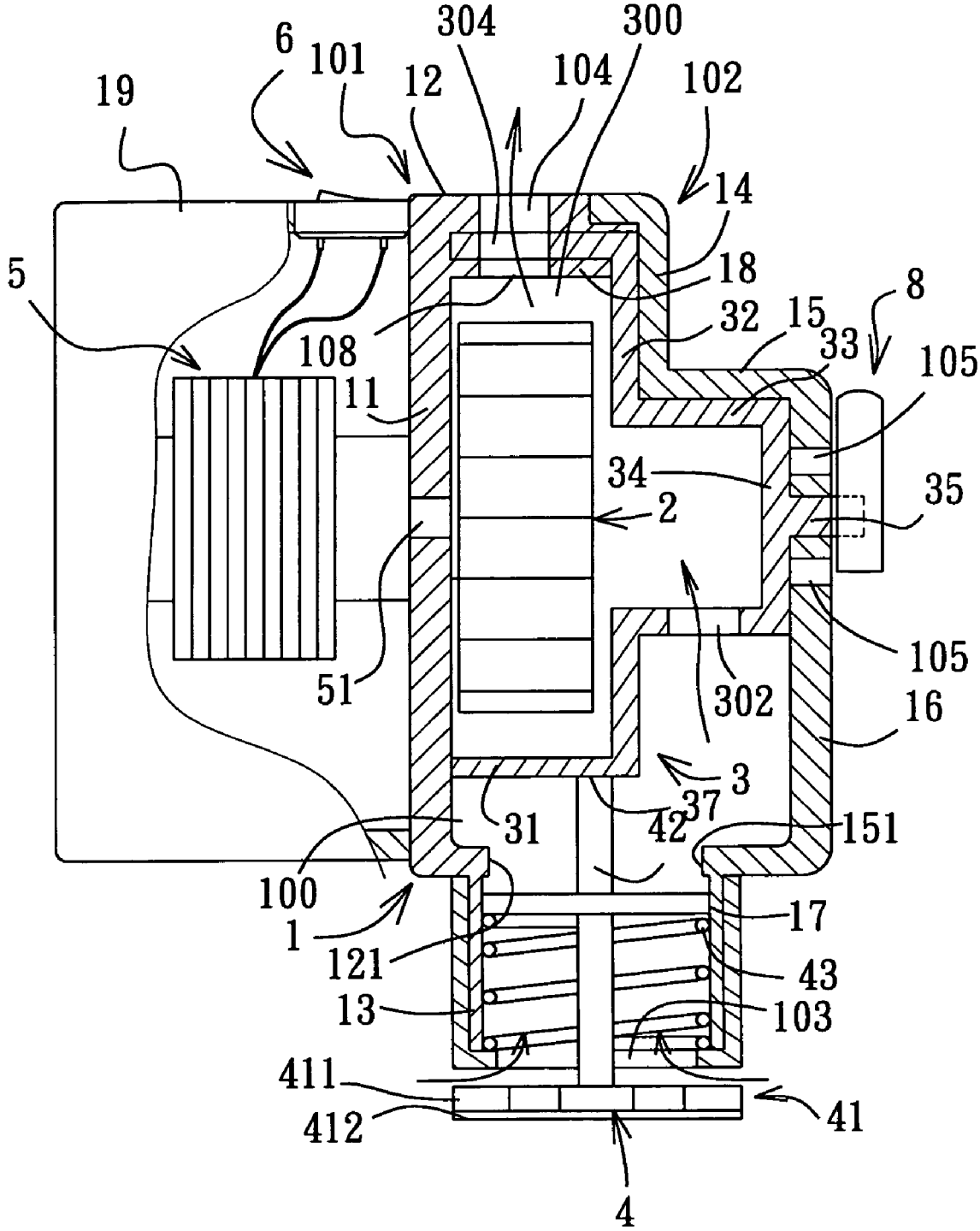
FIG. 4 is a sectional view illustrating the preferred embodiment when operated in a deflating mode.

The air flow controller 3 confines an air impeller chamber 300, is formed with a hole set, is mounted rotatably in the air control chamber 100, and is rotatable between inflating and deflating portions. In this embodiment, the hole set includes a pair of first holes 301, a second hole unit constituted by first and second apertures 303, 302, and a third hole 304. As shown in FIG. 3, when the air flow controller 3 is at the inflating position, the hole set is disposed such that the air inlets 105 and the valve hole 103 are in fluid communication with the air impeller chamber 300, and such that the air outlet 104 is fluidly isolated from the air impeller chamber 300. As shown in FIG. 4, when the air flow controller 3 is at the deflating position, the hole set is disposed such that the air outlet 104 and the valve hole 103 are in fluid communication with the air impeller chamber 300, and such that the air inlets 105 are fluidly isolated from the air impeller chamber 300.

In particular, when the air flow controller 3 is at the inflating position of FIG. 3, the first holes 301 are in fluid communication with the air inlets 105 to permit entry of ambient air into the air impeller chamber 300, the first aperture 303 permits fluid communication between the air control chamber 100 and the air impeller chamber 300, and the third hole 304 (see FIG. 4) is blocked by the housing 1 to prevent air flow from the air impeller chamber 300 out of the housing 1 through the air outlet 104. When the air flow controller 3 is at the deflating position of FIG. 4, the first holes 301 (see FIG. 4) are blocked by the housing 1 to prevent entry of ambient air into the air impeller chamber 300 through the first holes 301, the second aperture 302 permits fluid communication between the air control chamber 100 and the air impeller chamber 300, and the third hole 304 is in fluid communication with the air outlet 104 to permit air flow from the air impeller chamber 300 out of the housing 1 through the air outlet 104.

In this embodiment, the air flow controller 3 includes a first annular wall 31 surrounded by the first peripheral wall 12 of the first housing part 101, an annular fourth base wall 32 that extends radially and inwardly from the first annular wall 31, that is disposed to abut against the second base wall 14 of the second housing part 102, and that has an inner periphery, a second annular wall 33 that extends transversely from the inner periphery of the fourth base wall 32 in a direction away from the first annular wall 31, and that is surrounded by the second peripheral wall 15 of the second housing part 102, and a fifth base wall 34 connected to one end of the second annular wall 33 that is remote from the fourth base wall 32 and disposed adjacent to the third base wall 16 of the second housing part 102. The first holes 301 of the hole set are formed in the fifth base wall 34, and are aligned respectively with the air inlets 105 when the air flow controller 3 is at the inflating position (see FIG. 3). The third hole 304 of the hole set is formed in the first annular wall 31, and is aligned with the air outlet 104 when the air flow controller 3 is at the deflating position (see FIG. 4). The first aperture 303 is formed in the second annular wall 33, and the second aperture 302 is formed in the first annular wall 31. The first aperture 303 is angularly spaced apart from the second aperture 302 and the third hole 304.

Moreover, the air flow controller 3 is provided with a shaft 35 that extends from the fifth base wall 34 and outwardly of the housing 1 through the shaft hole 106 in the third base wall 16 of the second housing part 102. The shaft 35 defines a rotary axis of the air flow controller 3. A control lever 8 is disposed outwardly of the housing 1, is coupled to the shaft 35 of the air flow controller 3, and is operable so as to rotate the air flow controller 3 between the inflating and deflating positions about the rotary axis. It should be noted herein that other known mechanisms may be employed for driving rotation of the air flow controller 3 between the inflating and deflating positions. The check valve 4 is mounted in the valve hole 103, and is movable between control-enabled and control-disabled positions. As shown in FIG. 3, when the check valve 4 is at the control-enabled position, the check valve 4 blocks ambient air flow into the air control chamber 100 via the valve hole 103, and permits air flow from the air control chamber 100 out of the housing 1 through the valve hole 103. As shown in FIG. 4, when the check valve 4 is at the control-disabled position, the check valve 4 permits ambient air flow into the air control chamber 100 via the valve hole 103.

In this embodiment, the check valve 4 includes a valve piece 41 for blocking and unblocking the valve hole 103, a valve stem 42 coupled to the valve piece 41, and a biasing member 43 for biasing the valve piece 41 so as to dispose the check valve 4 at the control-enabled position. The valve piece 41 includes a frame 411 and a resilient valve plate 412 having a central part secured to an underside of the frame 411. When the check valve 4 is at the control-enabled position, air flow from the air control chamber 100 forces the valve plate 412 to yield such that the air can flow out of the housing 1 via the valve hole 103, as best shown in FIG. 3. On the other hand, the valve plate 412 does not permit ambient air flow into the air control chamber 100 via the valve hole 103 when the check valve 4 is at the control-enabled position.

The valve actuator 37 is provided on the air flow controller 3, and drives the check valve 4 to the control-disabled position when the air flow controller 3 is rotated to the deflating position, as best shown in FIG. 4. In this embodiment, the first annular wall 31 of the air flow controller 3 abuts against the valve stem 42 to serve as the valve actuator 37, and is formed with a control groove 36 that is aligned with the valve stem 42 when the air flow controller 3 is at the inflating position and that permits the valve stem 42 to extend therein, as best shown in FIG. 3, thereby enabling the valve piece 41 to block the valve hole 103 by virtue of biasing action of the biasing member 43, and thereby disposing the check valve 4 at the control-enabled position when the air flow controller 3 is at the inflating position.

The air impeller 2 is mounted rotatably in the air impeller chamber, and includes a circular base portion 21, an impeller shaft 22 extending from the base portion 21, and a plurality of vanes 23 provided on the base portion 21 around the impeller shaft 22. The impeller shaft 22 is coupled to the drive shaft 51 of the drive unit 5, which is responsible for driving rotation of the air impeller 2 in the air impeller chamber 300.

Referring to FIGS. 2, 3 and 4, in this embodiment, an inner annular wall 18 extends from the first base wall 11, and is spaced apart from and cooperates with the first peripheral wall 12 to form an annular groove for retaining and guiding rotation of the first annular wall 31 of the air flow controller 3. The inner annular wall 18 is formed with a through hole 108 that is aligned with the air outlet 104, and a notch 109 that is aligned with the valve hole 103. It should be noted herein that the presence of the inner annular wall 18 is optional and is not mandatory to the practice of the air pump of this invention.

When it is desired to inflate an article (not shown), the article is connected to the air pump of this invention at the valve hole 103. Thereafter, the control lever 8 is operated to rotate the air flow controller 3 to the inflating position (see FIG. 3), in which the first holes 301 and the first aperture 303 permit fluid communication among the air inlets 105, the valve hole 103 and the air impeller chamber 300, and in which the air outlet 104 is fluidly isolated from the air impeller chamber 300. At the same time, the check valve 4 is disposed at the control-enabled position due to alignment between the control groove 36 and the valve stem 42. When the switch device 6 is turned on, the drive unit 5 drives the air impeller 2 to rotate, thus causing ambient air to pass through the air inlets 105, the first holes 301, the first aperture 303 and the valve hole 103 so as to be supplied into the article.

On the other hand, when it is desired to deflate the article, the control lever 8 is simply operated without disassembling the air pump to rotate the air flow controller 3 to the deflating position (see FIG. 4), in which the third hole 304 and the second aperture 302 permit fluid communication among the air outlet 104, the valve hole 103 and the air impeller chamber 300, and in which the air inlets 105 are fluidly isolated from the air impeller chamber 300. At the same time, the valve actuator 37 drives the check valve 4 to the control-disabled position. Therefore, when the switch device 6 is turned on, the drive unit 5 drives the air impeller 2 to rotate, thus causing air inside the article to pass through the valve hole 103, the second aperture 302, the third aperture 304 and the air outlet 104 so as to be expelled to the atmosphere.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

We claim:

1. A two-way air pump comprising:

a housing confining an air control chamber and formed with a valve hole, an air outlet and an air inlet;

an air flow controller confining an air impeller chamber, formed with a hole set, mounted rotatably in said air control chamber, and rotatable between inflating and deflating portions, wherein, when said air flow controller is at the inflating position, said hole set is disposed such that said air inlet and said valve hole are in fluid communication with said air impeller chamber, and such that said air outlet is fluidly isolated from said air impeller chamber, and when said air flow controller is at the deflating position, said hole set is disposed such that said air outlet and said valve hole are in fluid communication with said air impeller chamber, and such that said air inlet is fluidly isolated from said air impeller chamber;

a check valve mounted in said valve hole and movable between control-enabled and control-disabled positions, wherein, when said check valve is at the control-enabled position, said check valve blocks ambient air flow into said air control chamber via said valve hole, and permits air flow from said air control chamber out of said housing through said valve hole, and when said check valve is at the control-disabled position, said check valve permits ambient air flow into said air control chamber via said valve hole;

a valve actuator provided on said air flow controller for driving said check valve to the control-disabled position when said air flow controller is rotated to the deflating position;

an air impeller mounted rotatably in said air impeller chamber; and a drive unit coupled to said air impeller for driving rotation of said air impeller in said air impeller chamber.

2. The two-way air pump as claimed in claim 1, wherein said hole set includes a first hole, a second hole unit, and a third hole, wherein, when said air flow controller is at the inflating position, said first hole is in fluid communication with said air inlet to permit entry of ambient air into said air impeller chamber, said second hole unit permits fluid communication between said air control chamber and said air impeller chamber, and said third hole is blocked by said housing to prevent air flow from said air impeller chamber out of said housing through said air outlet, and wherein, when said air flow controller is at the deflating position, said first hole is blocked by said housing to prevent entry of ambient air into said air impeller chamber through said first hole, said second hole unit permits fluid communication between said air control chamber and said air impeller chamber, and said third hole is in fluid communication with said air outlet to permit air flow from said air impeller chamber out of said housing through said air outlet.

3. The two-way air pump as claimed in claim 2, wherein said housing includes complementary first and second housing parts, said first housing part having a first base wall with an outer periphery, a first peripheral wall extending transversely from said outer periphery of said first base wall, a first notch formed in said first peripheral wall, and a first semi-tubular part extending transversely from and outwardly of said first peripheral wall at a periphery of said first notch, said second housing part having a second base wall configured with an inner periphery and an outer periphery that is connected to said first peripheral wall of said first housing part, a second peripheral wall extending transversely from said inner periphery of said second base wall away from said first housing part, a third base wall connected to one end of said second peripheral wall that is remote from said second base wall, a second notch formed in said second peripheral wall, and a second semi-tubular part extending transversely from and outwardly of said second peripheral wall at a periphery of said second notch, said first base wall and said first peripheral wall of said first housing part cooperating with said second base wall, said second peripheral wall and said third base wall of said second housing part to confine said air control chamber, said first and second semi-tubular parts of said first and second housing parts cooperating to define said valve hole, said air outlet being formed in said first peripheral wall of said first housing part, said air inlet being formed in said third base wall of said second housing part.

4. The two-way air pump as claimed in claim 3, wherein said air flow controller includes:

a first annular wall surrounded by said first peripheral wall of said first housing part, an annular fourth base wall that extends radially and inwardly from said first annular wall, that is disposed to abut against said second base wall of said second housing part, and that has an inner periphery, a second annular wall that extends transversely from said inner periphery of said fourth base wall in a direction away from said first annular wall, and that is surrounded by said second peripheral wall of said second housing part, and a fifth base wall connected to one end of said second annular wall that is remote from said fourth base wall and disposed adjacent to said third base wall of said second housing part, said first hole of said hole set being formed in said fifth base wall and being aligned with said air inlet when said air flow controller is at the inflating position, said third hole of said hole set being formed in said first annular wall and being aligned with said air outlet when said air flow controller is at the deflating position.

5. The two-way air pump as claimed in claim 4, wherein said second hole unit of said hole set includes a first aperture formed in said second annular wall, and a second aperture formed in said first annular wall, said first aperture being angularly spaced apart from said second aperture and said third hole of said hole set.

6. The two-way air pump as claimed in claim 4, wherein said check valve includes:

a valve piece for blocking and unblocking said valve hole;

a valve stem coupled to said valve piece; and a biasing member for biasing said valve piece so as to dispose said check valve at the control-enabled position.

7. The two-way air pump as claimed in claim 6, wherein said first annular wall of said air flow controller abuts against said valve stem to serve as said valve actuator, said first annular wall being formed with a control groove that is aligned with said valve stem when said air flow controller is at the inflating position and that permits said valve stem to extend therein, thereby enabling said valve piece to block said valve hole by virtue of biasing action of said biasing member, and thereby disposing said check valve at the control-enabled position when said air flow controller is at the inflating position.

8. The two-way air pump as claimed in claim 4, wherein said air flow controller is provided with a shaft that extends from said fifth base wall and outwardly of said housing through said third base wall of said second housing part, said shaft defining a rotary axis of said air flow controller, said air pump further comprising a control lever disposed outwardly of said housing, coupled to said shaft of said air flow controller, and operable so as to rotate said air flow controller between the inflating and deflating positions about the rotary axis.

9. The two-way air pump as claimed in claim 1, wherein said air flow controller is provided with a shaft that extends outwardly of said housing and that defines a rotary axis of said air flow controller, said air pump further comprising a control lever disposed outwardly of said housing, coupled to said shaft of said air flow controller, and operable so as to rotate said air flow controller between the inflating and deflating positions about the rotary axis.

* * * * *